United States Patent [19]

Paul

[11] 4,110,654

[45] Aug. 29, 1978

[54] DEVICE FOR MONITORING THE TRAVEL OF YARN-LIKE STRUCTURES AT A TEXTILE MACHINE

[75] Inventor: Andreas Paul, Uetikon am See, Switzerland

[73] Assignee: Gebr. Loepfe AG, Zurich, Switzerland

[21] Appl. No.: 589,627

[22] Filed: Jun. 23, 1975

[30] Foreign Application Priority Data

Jul. 12, 1974 [CH] Switzerland ..... 9630/74

[51] Int. Cl.[2] ..... H01L 41/10

[52] U.S. Cl. ..... 310/323; 310/326; 310/330; 310/332; 139/371

[58] Field of Search ..... 310/8.2, 8.3, 8.5, 8.6, 310/9.1, 9.4, 321, 322, 323, 330–332, 326, 339; 139/371; 73/194 B, 70.2

[56] References Cited

U.S. PATENT DOCUMENTS

| | | | |
|---|---|---|---|
| 2,352,311 | 6/1944 | Di Toro | 310/8.5 X |
| 2,561,763 | 7/1951 | Waters et al. | 310/8.2 X |
| 2,578,620 | 12/1951 | Wilhelm | 310/8.7 |
| 3,297,889 | 1/1967 | Breskend | 310/8.5 X |
| 3,377,439 | 4/1968 | Rouy | 310/8.5 X |
| 3,467,149 | 9/1969 | Dosch et al. | 139/371 |
| 3,519,800 | 7/1970 | Shill | 310/8.5 X |

*Primary Examiner*—Mark O. Budd
*Attorney, Agent, or Firm*—Kleeman, W.

[57] ABSTRACT

A device for monitoring the travel of yarn-like structures at a textile machine comprises a cantilever member vibrating in a flexural mode when excited by a traveling yarn which is in contact with the upper or free end of said cantilever member. The lower end thereof is rigidly connected or integral with a rigid base member having the effect of a seismic mass when exposed to shock or vibration. Moreover, soft elastic material is provided to prevent transfer of such shock or vibration from the textile machine to the cantilever member. A mechano-electrical transducer element, e.g., a piezoelectric element, is comprised by or coupled with the cantilever member for generating an electrical yarn travel signal. A casing may be provided for protecting said cantilever member against ambient noise and other undesired actions acting from outside the casing.

3 Claims, 4 Drawing Figures

DEVICE FOR MONITORING THE TRAVEL OF YARN-LIKE STRUCTURES AT A TEXTILE MACHINE

BACKGROUND OF THE INVENTION

The present invention relates to a new and improved device for monitoring the yarn travel at a textile machine. The device comprises a yarn scanning structure including a flat or plate-like cantilever member which can be excited into oscillation by the traveling yarn, and mechano-electrical transducing means, e.g., a piezoelectric transducer element responsive to such oscillation.

Generally, such a device serves for stopping the textile machine when the yarn breaks or ceases to travel on its predetermined path in the machine.

U.S. Pat. No. 3,467,149 and Swiss Pat. No. 441,172 disclose electronic devices for surveying the presence of weft thread in a shuttle loom which comprise a piezoelectric signal generator arranged in the shuttle. As shown in detail in said United States patent, the shuttle is formed with a hollow central chamber, within which is mounted a weft bobbin. The weft thread is played out from the front end of the bobbin and passes over the signal generator near the front of the shuttle; and then it leaves the shuttle via an output guide. The signal generator itself comprises a base member mounted in the shuttle between rubber bearings, an elongated piezoelectric crystal and a wire-like L-shaped thread feeler element both of which are mounted at the base member. The elongated piezoelectric crystal is supported at each end thereof by means of mounting elements such as to extend horizontally above the base member and transversely to the shuttle. The thread feeler element is mounted at one end thereof on the base member and bends over to extend above and in parallel relationship to the elongated piezoelectric crystal. A vibration coupling member interconnects the thread feeler element and the piezoelectric crystal at a point midway between the two mounting elements. The weft thread presses slightly downwards upon the wire-like thread feeler element traversing along the free end thereof on its way from the free end of the weft bobbin to the output guide of the shuttle.

In piezoelectric signal generators of the prior art elastic members or elements are generally provided for mounting the piezoelectric crystal and coupling same to the thread feeler element. Such a coupling member acts as a vibration transferring as well as a vibration damping means when the signal is generated. Elastic mounting elements generally cause damping or attenuation of the signal as well as suppression of noise and unwanted vibration and shock which might damage the piezoelectric crystal. A certain amount of damping may be advantageous in order to let the yarn travel signal decay rapidly when the yarn breaks. However, when the vibratory transducer system has a relatively high fundamental frequency and high inherent attenuation, additional elastic damping elements might induce undesired loss to the yarn travel signal.

Moreover, a piezoelectric crystal or other vibratory transducer element supported or clamped at each end and working in flexural vibration mode has a high flexural stiffness and thus requires a high force for being excited into oscillation. Additionally, such a transducer element has a high fundamental frequency compared with a unilaterally clamped or cantilever transducer element of equal structure and dimensions. As a consequence, a piezoelectric transducer element supported or clamped at each end furnishes a relatively low signal when excited directly or indirectly by a traveling yarn.

Now one might seek to enhance the mechano-electrical sensitivity or response to mechanical vibration of such a piezoelectric or other vibratory transducer system by constructive measures. However, such measures generally cause not only the desired signal, i.e., the yarn travel signal, but also the undesired noise signals to be increased. In textile factories such noise signals may be produced by ambient sound transmitted by air or by vibrations produced in the textile machine and conducted through solid elements to the transducer system.

Air transmitted sound may be generated by auxiliary devices mounted at the textile machine itself, by fans, compressed air tools or other machines, whereas the vibrations transmitted through solid elements mainly come from the textile machine itself at which the vibratory transducer system is mounted. A serious problem is the sound produced by compressed air tools generally used for cleaning the textile machines, which has a broad frequency spectrum and thus is difficult to neutralize.

SUMMARY OF THE INVENTION

It is a primary object of the invention to provide a yarn travel monitoring device which is designed to enhance the level of the yarn travel signal and at the same time to reduce the effect of the noise sources, that means which exhibits a great signal-to-noise ratio.

A further objective of the invention is the construction of a vibratory transducer system comprising a vibratory member having only one degree of freedom of vibration and which may be excited mainly or solely in its fundamental frequency.

A more specific object of the invention is to provide a transducer system on which noise sources emitting vibration or sound within defined frequency ranges have little or no effect.

In order to implement the aforementioned objectives and others which will become more readily apparent as the description proceeds, the inventive yarn travel monitoring device is generally characterized by the improvement that it comprises a rigid base structure having a mass greater than the mass of said yarn scanning structure, one end of the cantilever member being rigidly connected with said rigid base structure; means for supporting said rigid base structure and yarn scanning structure and for mounting them at the textile machine; and soft elastic means arranged between and adjacent said supporting means and the rigid base structure for preventing transfer of mechanical shock and vibration from the textile machine to the yarn scanning structure.

The term—yarn scanning structure—as used in the present specification is meant to comprise all parts of the yarn travel monitoring device which are excited to vibrate, or participate in the oscillation induced by the traveling yarn, and thus take part in the formation of the yarn travel signal. Such a structure may comprise a transducer element, e.g., a plate-shaped piezoelectric ceramic body provided with electrodes, and a body of hard material fixed to the transducer element and contacting the traveling yarn.

The rigid base structure may be formed as a metallic block or cube and may have a mass greater than, e.g., at least five times the mass of the yarn scanning structure. With such an arrangement, said rigid base structure together with the yarn scanning structure and the soft elastic material forms a second vibratory system having a fundamental frequency far below the fundamental frequency of the yarn scanning structure. As a consequence, such a second vibratory system is capable to suppress vibration conducted through solid components of the textile machine to the monitoring device when the latter is mounted at the machine. Of course, it is not possible to define a certain mass ratio as stated above as a general rule, since the said fundamental frequencies are also dependent upon parameters other than the mass, e.g., the dimensions and the elastic properties of the vibratory systems involved.

Since the yarn scanning structure vibrates as a cantilever or flexural member unilaterally fixed at the rigid base structure or body, a node is defined at the fixing zone. Thus vibration of the cantilever member in a defined frequency, mainly in the fundamental, is favored, and said rigid base structure—like a seismic mass—is unable to participate in the vibration of the cantilever member.

In order to avoid vibration to be transferred from the rigid base structure to the yarn scanning structure, the ratio of the fundamental frequencies of said yarn scanning structure and said second vibratory system might be determined other than an integral number.

Moreover, the soft elastic means or material which bears the rigid base structure may be chosen such as to absorb or attenuate vibrations transferred from the textile machine through the rigid parts thereof. However, even in the event that a certain minimum oscillation of the rigid base structure might be excited by such machine vibrations, excitation of the resonant frequency of the yarn scanning structure will be avoided when the ratio of said fundamental frequencies deviates from an integral member.

The vibration absorbing soft elastic means or material may be an elastic organic material, as porous rubber, e.g., foam rubber or sponge rubber, or other lossy material. The mechano-electrical transducing means may be a self-supporting member, e.g., a plate-shaped piezoelectric transducer element, or it may be attached or cemented to a self-supporting or cantilever member which substantially determines the fundamental frequency of the yarn scanning structure. In the latter case, the transducing means may be a thin or film-shaped element as will be illustrated with reference to the exemplified embodiments.

The monitoring device of the invention can be designed as a multiple device for scanning a number of threads or yarns simultaneously. An individual yarn scanning structure may be provided for each of the yarns, said yarn scanning structures being fixed at a common elongated rigid base structure and arranged in a common casing. Such a multiple scanning device may be used for multicolour looms, warping creels, and so on.

It is advantageous to design the vibratory yarn scanning structure for a particular use in such a manner that the resonant frequency thereof is located in a region free of disturbance. Supposing that machine vibrations are present mainly in a range below 1 kc/s, and air transmitted noise and sound mainly in a range above 5 kc/s. In such a case, the fundamental or resonant frequency of the yarn scanning structure may be chosen in the region between 1 and 5 kc/s, e.g., at or close to 3 kc/s.

In any case, the vibratory system comprising the rigid base structure and soft elastic material can be designed such that its fundamental or resonant frequency is in a range far below the resonant frequency of the yarn scanning structure, using the known relation that the resonant frequency of a linear vibratory system—not regarding the damping—is proportional to the root of spring force divided by mass.

In order to suppress the effect of air transmitted noise and sound onto the vibratory yarn scanning structure, a casing may be provided, and the device constructed such as to render the exposed area of the yarn scanning structure as small as possible.

BRIEF DESCRIPTION OF THE DRAWINGS

The invention will be better understood and objects other than those set forth above will become apparent upon consideration of the following detailed description thereof which refers to the annexed drawings wherein.

DETAILED DESCRIPTION OF THE PREFERRED EMBODIMENTS

Figure 1:
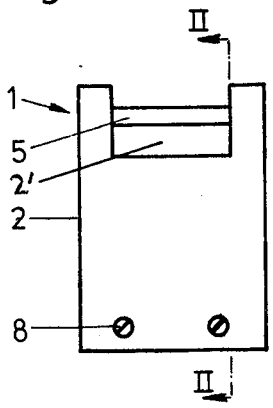
FIG. 1 is a schematic front view of a monitoring head designed for scanning a single yarn or thread.
Figure 2:
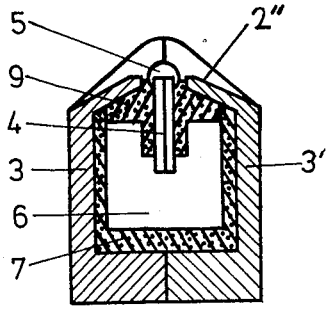
FIG. 2 is a cross section of the monitoring head shown in FIG. 1, taken along the line II—II in FIG. 1.

With reference to FIGS. 1 and 2, the monitoring head 1 is provided with a casing 2 consisting of two equal shells 3, 3′ interconnected by screws 8. Casing 2 encloses a yarn scanning structure or system comprising a plate-shaped piezoelectric transducer element 4 and a thereto cemented rod-shaped body or yarn guide means 5 made of a material of great surface hardness. Transducer element 4 may be a so-called bimorph element as known in the art, consisting of two adjacent piezoelectric wafers and three electrodes, i.e., one electrode at the interface of said wafers and one electrode on each of the exposed outer surfaces thereof. The direction of the yarn travel in FIG. 1 is perpendicular to the drawing plane, and in FIG. 2 in the drawing plane and tangential to rod-shaped body 5, and running, e.g., from left to right. Since the components 4, 5 are firmly cemented with one another, they form a system able to vibrate uniquely in a flexural mode.

FIG. 2 shows the small side of the piezoelectric transducer element 4, the thickness of which is drawn greater than its natural thickness, for the sake of clearness. Yarn guide means 5 is cemented to and extends along the upper edge of transducer element 4 as may be seen from FIGS. 1 and 2. With reference to FIG. 2, the casing comprises two equal shells 3, 3′ and includes a rigid base member or block 6 which may be made of a heavy material, as brass, and in which the lower edge of transducer element 4 is rigidly clamped or cemented. When block 6 is made of an electrically conducting material, as metal, the electrodes (not shown) of piezoelectric transducer element 4 should be insulated from said block in order to avoid short-circuiting. By way of example, the mass of block 6 may be five times the mass of the yarn scanning structure comprising transducer element 4 and yarn guide 5, however, that mass ratio should be chosen, depending upon the fundamental frequency of the yarn scanning structure and the desired magnitude of the signal-to-noise ratio and the parameters stated in the foregoing summary. Of course, block 6 may be also made of a light or insulating material, however, the use of heavy material is favorable for a space-saving design of the monitoring head.

Block 6 is supported in casing 2 by soft elastic material 7 located between the inner walls of shells 3, 3' and the bottom and side walls of block 6. As mentioned in the foregoing context, the soft elastic material 7 may be sponge rubber or other loose elastic material for absorbing shock and undesired machine vibrations conducted from the frame of the textile machine to the thereto fixed casing 2. Shells 3, 3' each have a tilted top 2' and 2'', respectively, the upper edges of which form an elongated opening between them for exposing yarn guide 5 to the traveling yarn, leaving only a tight slot on each longitudinal side of yarn guide 5. Thus, the sensitive piezoelectric transducer element 4 is shielded from dust, humidity and other chemical and mechanical influences from outside the casing. In order to attain a still better protection of transducer element 4, the free space between the top of block 6 and the tilted tops 2', 2'' of casing 2 may be filled with an elastic sealing material of low density which, however, should not damp oscillation of transducer element 4 to a substantial degree.

In view of the rigid interconnection of block 6 and piezoelectric transducer element 4, the latter has a nodal line along its lower edge clamped in block 6 and thus performs a well defined flexural vibration in its fundamental frequency when excited by a yarn traveling over yarn guide 5. Because of the relatively heavy mass of block 6 and the energy reflection at the interface of transducer element 4 and block 6, loss or dissipation of vibrational energy from transducer element 4 is avoided so that the latter is highly responsive to the motion of the traveling yarn.

The design as illustrated in FIGS. 1 and 2 allows for the manufacture of yarn travel monitoring heads having practicable dimensions and frequency responses in a desirable kc/s order.

Figure 3:
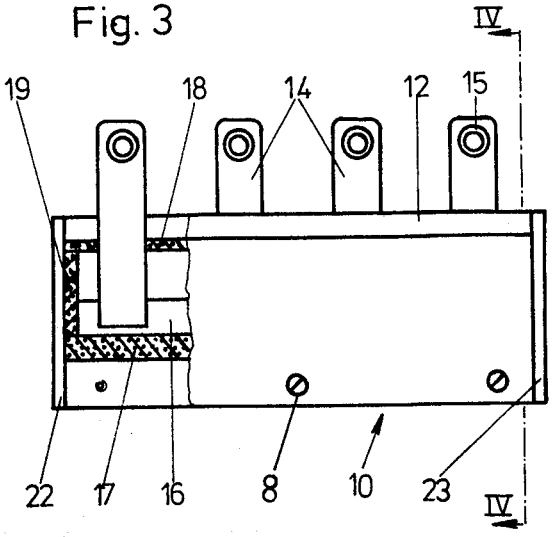
FIG. 3 is a front view of a multiple monitoring head designed for scanning four yarns or threads simultaneously.
Figure 4:
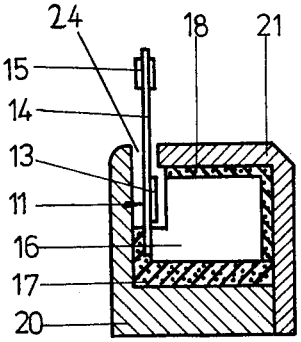
FIG. 4 is a cross section of the multiple monitoring head illustrated in FIG. 3, taken along the line IV—IV in FIG. 3.

FIGS. 3 and 4 illustrate an embodiment of a quadruple monitoring head 10 which exhibits an extremely low response to direct mechanical shock and vibration acting on its casing 12. Four individual yarn scanning structures 11, FIG. 4, are arranged in substantially parallel relationship to each other in the common elongated casing 12. Each of the yarn scanning structures 11 comprises a vibratory cantilever member 14, a mechano-electrical or vibrato-electrical transducer element 13, and a ring-shaped yarn guide 15. Cantilever member 14 is formed as a lamella of substantially rectangular shape which may be made of metal, e.g., brass. Yarn guide 15 is made of a hard material, as ceramic oxide, and fixed in an aperture near the upper free end of cantilever member 14. An elongated rigid base member or bar 16 is located inside elongated casing 12 and bears said cantilever members 14, the lower ends of which are rigidly fixed to rigid base member 16, e.g., by welding. Each cantilever member 14 bears a mechano-electrical transducer element 13 which is cemented to one of the plane surfaces of cantilever member 14 within elongated casing 12. When excited by a yarn traveling through yarn guide 15, yarn scanning structure 11 vibrates as an integral unit in a flexural mode.

Elongated base member 16 is supported in elongated casing 12 by soft elastic vibration damping material 17, 18 and 19 in a similar manner as block 6 is supported in casing 2 with the embodiment shown in FIGS. 1 and 2.

Elongated casing 12 as viewed from the front side shown in FIG. 3 has the shape of an oblong rectangle, whereas its cross section, FIG. 4, is of rectangular or substantially quadratic shape. Elongated casing 12 comprises a front shell 20 and a rear shell 21 both of L-shaped cross section, and two end walls 22, 23. Shells 20 and 21 are connected with one another by screws 8 shown in FIG. 3, and the end walls 22, 23 may be integral with one of shells 20, 21 or cemented or screwed to same. An oblong aperture 24 is formed between the upper and front edges of the two shells 20, 21, respectively, on top of casing 12 through which aperture the upper ends of the cantilever members 14 bearing the yarn guides 15 protrude. For reducing the influence of air transmitted noise and sound, it may be advantageous to design the monitoring head illustrated in FIGS. 3 and 4 such that the cantilever members 14 protrude over the top of casing 12 just enough to fully expose yarn guides 15.

The vibratory yarn scanning structures shown in FIGS. 1 and 2, on the one hand, and FIGS. 3 and 4, on the other hand, exhibit substantially different constructions. In the first case, said yarn scanning structure comprises two components 4, 5, namely a self-supporting piezoelectric transducer element 4 and a yarn guide 5. Yarn guide 5 is formed as a rod-shaped body and connected directly with transducer element 4. In the second case, the yarn scanning structure 11 comprises three components 13, 14, 15. Transducer element 13 is not self-supporting and fixed to the relatively long vibratory cantilever member or lamella 14 which bears the ring-shaped yarn guide 15. Since the yarn scanning structure of the first mentioned embodiment comprises only two components 4, 5, the fundamental frequency of that yarn scanning structure is substantially dependent upon the physical properties and mounting of the piezoelectric transducer element 4, whereas in the second embodiment comprising three components, generally cantilever member 14 is the component which substantially determines the fundamental or resonant frequency. Further, with reference to FIG. 2, transducer element 4 is attached or clamped to rigid block 6, whereas in FIG. 4 cantilever member 14 is fixed at rigid bar 16.

Transducer elements other than those mentioned with reference to the drawings may be used with the yarn scanning structures of the invention, e.g., transducers having a stress or shape dependent electric resistivity, as piezoresistive transducers, e.g., strain gauges of semiconductor material, or electret films or plates and other capacitive transducers as used in condenser microphones and loudspeakers. Particularly, such transducer elements shaped as thin layers or films which are not self-supporting may be provided at one or both sides of a flat vibratory cantilever member of the type shown in FIGS. 3 and 4, in a similar manner as transducer element 13 which is cemented to one side of cantilever member 14. Of course, also piezoelectric flat or thin transducer elements may be provided at cantilever member 14.

Further, the yarn guide means, as ring-shaped member 15 in FIGS. 3 and 4, may be replaced by a simple hole or open slot in cantilever member 14. In addition, a layer of hard material, as ceramic oxide, may be applied along the edges of such a hole or slot by methods known in the art.

The invention allows for a multiplicity of structural changes with respect to the illustrated and above described preferred embodiments and thus it is possible to design the monitoring device of the invention for many particular and different uses and in a great variety of other and different advantageous embodiments.

While there is shown and described present preferred embodiments of the invention, it is to be distinctly understood that the invention is not limited thereto, but may be otherwise variously embodied and practiced within the scope of the following claims.

Accordingly, what is claimed is:

1. A device for monitoring the travel of yarn-like structures at a textile machine, comprising:

a yarn scanning structure including a plate-shaped cantilever member which can be excited into oscillation by the traveling yarn-like structure, and mechano-electrical transducing means responsive to such oscillation;

said plate-shaped cantilever member having an upper edge and opposite thereto a lower edge, yarn guiding means provided adjacent said upper edge;

a rigid base structure having a mass greater than the mass of said yarn scanning structure, said lower edge of the plate-shaped cantilever member being rigidly connected with said rigid base structure;

a hollow casing receiving said rigid base structure and said lower edge of the plate-shaped cantilever member, said hollow casing having a slot for exposing said yarn guiding means to the traveling yarn-like structure;

soft elastic means arranged between and adjacent said hollow casing and the rigid base structure for preventing transfer of mechanical shock and vibration from the textile machine to the yarn scanning structure; and said cantilever member is a piezoelectric transducer element and said yarn guiding means is an elongated body made of hard material and fixedly attached to the free upper end of said piezoelectric transducer element.

2. The device as defined in claim 1, wherein said plate-shaped cantilever member has flat faces and said transducing means comprises at least one mechano-electrical transducer element attached to said cantilever member on at least one of the flat sides thereof.

3. The device as claimed in claim 2, wherein the yarn guding means is made of a hard material.

* * * * *